US005090341A

United States Patent [19]

Satterfield

[11] Patent Number: 5,090,341

[45] Date of Patent: Feb. 25, 1992

[54] HAND-HELD TUFTING MENDING GUN

[75] Inventor: William H. Satterfield, Dalton, Ga.

[73] Assignee: Spencer Wright Industries, Inc., Dalton, Ga.

[21] Appl. No.: 584,456

[22] Filed: Sep. 18, 1990

[51] Int. Cl.[5] ..... D05C 15/08

[52] U.S. Cl. ..... 112/80.04; 112/80.05

[58] Field of Search ..... 112/10, 25, 26, 27, 112/80.01, 80.03-80.06, 85, 169, 410

[56] References Cited

U.S. PATENT DOCUMENTS

| | | | |
|---|---|---|---|
| 1,873,257 | 8/1932 | Ashby | 112/80.03 |
| 2,422,126 | 6/1947 | Parker | 122/80.04 |
| 2,442,906 | 6/1948 | Shay | 112/80.04 |
| 2,753,820 | 7/1956 | Lustig | 112/80.04 |
| 2,837,045 | 6/1958 | Gifford | 112/80.04 |
| 2,862,466 | 12/1958 | Bryant et al. | 112/80.04 |
| 2,879,731 | 3/1959 | Ward et al. | 112/80.04 |
| 2,887,076 | 5/1959 | Sterner | 112/80.04 |
| 3,142,276 | 7/1964 | Schauer | 112/80.04 |
| 3,144,844 | 8/1964 | Elliott et al. | 112/80.04 |
| 3,225,723 | 12/1965 | Wilkes | 112/80.04 |
| 3,229,653 | 1/1966 | Roberti et al. | 112/80.04 |
| 3,389,667 | 6/1968 | Mueller | 112/80.04 |
| 4,006,694 | 2/1977 | Thaheld et al. | 112/80.05 |
| 4,007,698 | 2/1977 | Thaheld et al. | 112/80.05 X |
| 4,123,985 | 11/1978 | Frentress | 112/80.05 X |
| 4,132,182 | 1/1978 | Heemstra | 112/80.05 X |
| 4,388,881 | 6/1983 | Price | 112/80.05 X |
| 4,488,498 | 12/1984 | Smith | 112/80.05 X |
| 4,557,265 | 12/1985 | Andersson | 112/80.04 X |

FOREIGN PATENT DOCUMENTS

| | | | |
|---|---|---|---|
| 02621360 | 11/1977 | Fed. Rep. of Germany | 112/80.04 |
| 0742272 | 3/1933 | France | 112/80.03 |
| 0564802 | 7/1957 | Italy | 112/80.04 |
| 0618165 | 2/1949 | United Kingdom | 112/80.04 |

*Primary Examiner*—Werner H. Schroeder
*Assistant Examiner*—Ismael Izaguirre
*Attorney, Agent, or Firm*—Alan Ruderman

[57] ABSTRACT

A hand-held tufting mending gun has a housing to which a pneumatic cylinder is fixedly mounted, the piston rod of the cylinder being connected to a needle drive member. The needle drive member is a gear rack and has its teeth in mesh with a pinion gear, the pinion gear in turn meshes with another gear rack formining the drive member of a yarn manipulating plunger. A hollow needle is attached to the forward end of the needle drive member and a yarn manipulating member is attached to the front of the plunger drive member. The piston of the pneumatic cylinder is double acting and pushes the needle drive member to drive it forwardly and pulls it back to drive it rearwardly, the action being controlled by operator influenced valving. As the needle moves forwardly, the plunger moves rearwardly and vice versa. An operator influenced trigger may control valving such that each depression and release of the trigger cycles the piston once to form one stitch, or may control valving which results in a series of stitches slowly being formed while the trigger is depressed. The single stitch or the slowly formed stitches provide an operator with control so that stitches may be inserted at precise locations to correct faults in a carpet being produced.

12 Claims, 3 Drawing Sheets

HAND-HELD TUFTING MENDING GUN

BACKGROUND OF THE INVENTION

This invention relates to hand-held tufting machines and more particularly to a hand-held tufting machine using pneumatic power wherein an operator can precisely control the operation of the stitch forming instrumentalities.

Hand-held tufting machines, also known as mending guns, are universally used for correcting faults in tufted fabric such as carpeting. For example, if for some reason, such as a broken yarn, one or a few needles of a tufting machine in the manufacture of carpeting do not form stitching in the backing material, the missing stitches are inserted by the use of such mending guns. Known prior art mending guns are illustrated in U.S. Pat. Nos. 2,753,820; 2,837,045; 2,862,466; 2,879,731; 2,887,076; 3,142,276; 3,144,844; 3,225,723; 3,229,653; 3,389,667; 3,645,219; 4,006,694; 4,007,698; 4,132,182; and 4,388,881. Other uses of such guns may be found in the manufacture of customized rugs.

Because of the ready availability of the supply of compressed air in carpet mills most of the current mending guns are pneumatically driven, the gun having a small pneumatic rotary turbine motor within the handle for reciprocably driving the needle. Other such guns which use an electric motor for driving the needle are generally used for manufacturing customized rugs or for craft purposes where a supply of pressurized air is not readily available. The only known proposal for a pneumaticaly driven mending gun not having a rotary motor is that illustrated in the aforesaid U.S. Pat. No. 4,388,881 assigned to the common assignee of the present invention. There a piston/cylinder assembly was proposed with the piston reciprocating within a pivotably mounted housing that cyclically pivoted in alternate directions with each stroke of the piston to open and close ports in the piston housing for ingress and egress of air. The piston was double acting and as it reached the end of its stroke at each end of the piston housing, the housing pivoted to receive high pressure air at the end reached by the piston so as to drive the piston in the reverse direction. The piston was eccentrically mounted to a crank for driving the needle. Because of the complexities of the pivotable housing arrangement, that proposal was never adopted for manufacture. It may be pointed out that in all of the aforesaid patents the mending guns or hand-held tufters utilized some form of crank driven stitch forming instrumentalities.

The mending guns currently utilized in carpet mills are of the type illustrated in the aforesaid U.S. Pat. Nos. 3,225,723 and 3,645,219. These mending guns since they are driven by pneumatic motors drive the needle and other stitch forming instrumentalities in a very rapid manner. Although this is desirable for unpatterned carpet fabric since all the operator has to do is hold the presser foot of the gun against the backing material along the row in which the tufting machine did not form stitching and feed the gun to fill in the missing stitches. The rapid action of the stitch forming instrumentalities is therefore useful in such instances. However, a substantial amount of patterned carpet fabric is currently being manufactured, such patterning being performed by sliding one or more needle bars of the tufting machine laterally so that an array of various zig-zag stitches are formed on the backing material surface remote from the pile surface. Some of the patterns are such that some zig-zag stitches overlay other zig-zag stitches. Because of the rapid action of the known mending guns, the operator has no control as to the placement of the stitches applied by the mending gun. Once the trigger of the gun is squeezed, a substantial number of stitches are formed, and it becomes difficult, if not virtually impossible, for an operator to place an array of zig-zag stitching into the backing material where a tufting machine needle has omitted the zig-zag stitch. When this occurs, defective fabric is produced thereby increasing the manufacturing costs.

SUMMARY OF THE INVENTION

Consequently, it is a primary object of the present invention to provide a simple inexpensive pneumatic hand-held tufting machine or mending gun which provides the operator with substantial control so as to place stitches at selected locations.

It is another object of the present invention to provide a hand-held tufting machine or mending gun having a pneumatically driven piston/cylinder assembly wherein one or a selected few stitches may be formed in a backing material.

It is a further object of the present invention to provide a drive assembly for a hand-held tufting machine or mending gun having stitch forming instrumentalities driven in a linear path by means of a pneumatic piston/-cylinder assembly fixedly attached to the mending gun.

Accordingly, the present invention provides a pneumatically actuated hand-held tufting machine or mending gun wherein the operator is provided with precise control over the reciprocation of the stitch forming instrumentalities so that stitches may be inserted at precise locations in the backing material for correcting faults in carpet being produced. To this end the present invention provides a pneumatically powered mending gun having a housing to which the casing or housing of a pneumatic piston/cylinder is fixedly mounted, the piston rod of the pneumatic cylinder being connected to a needle drive member. The needle drive member is mechanically coupled to a yarn manipulating needle plunger drive member such that when the needle moves forwardly the plunger moves rearwardly and vice versa. The piston/cylinder is double acting and pushes the needle drive member to drive it forwardly and pulls it back to drive it rearwardly, the action being controlled by operator influenced valving. When the needle is driven forwardly it punches a hole in the carpet backing and when the needle plunger is driven forwardly it grasps yarn carried by the now rearwardly moving needle and pulls a loop of yarn to the desired pile height relative to the backing. The valving may be such that the operator controls each forward and rearward movement of the needle and needle plunger by depressing and releasing a valve influenced trigger to form one stitch each time the trigger is depressed and released, or may be such that depression of the trigger results in the needle slowly moving forwardly and rearwardly to form a series of stitches, the slow action allowing each stitch to be selectively placed at a desired location in the backing.

In the preferred form of the invention the needle drive member and the plunger drive member are each constrained for slidable reciprocation in slideways formed in the housing. The preferred form of the drive members are gear racks having teeth operatively connected to a pinion gear which is rotatably driven in a first direction as the needle rack is driven forwardly by the piston rod and in the opposite direction as the needle rack is driven rearwardly by the piston rod. As the pinion rotates in the first direction, the needle plunger rack is driven rearwardly and when it rotates in the opposite direction the plunger rack is driven forwardly.

The operator influenced valving may include valve means within the housing operable upon depression of the trigger to open an air passage for receiving pressurized air from a main air channel within the housing and when the trigger is released closes the passage. When the passage is closed the needle is in the forward position, and when the passage is open the needle is driven rearwardly and the plunger driven forwardly once, and upon release of the trigger the needle is again driven forwardly. Alternatively, the valving may act to move the plunger and the needle in step-wise fashion slowly through a number of cycles until the trigger is released.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
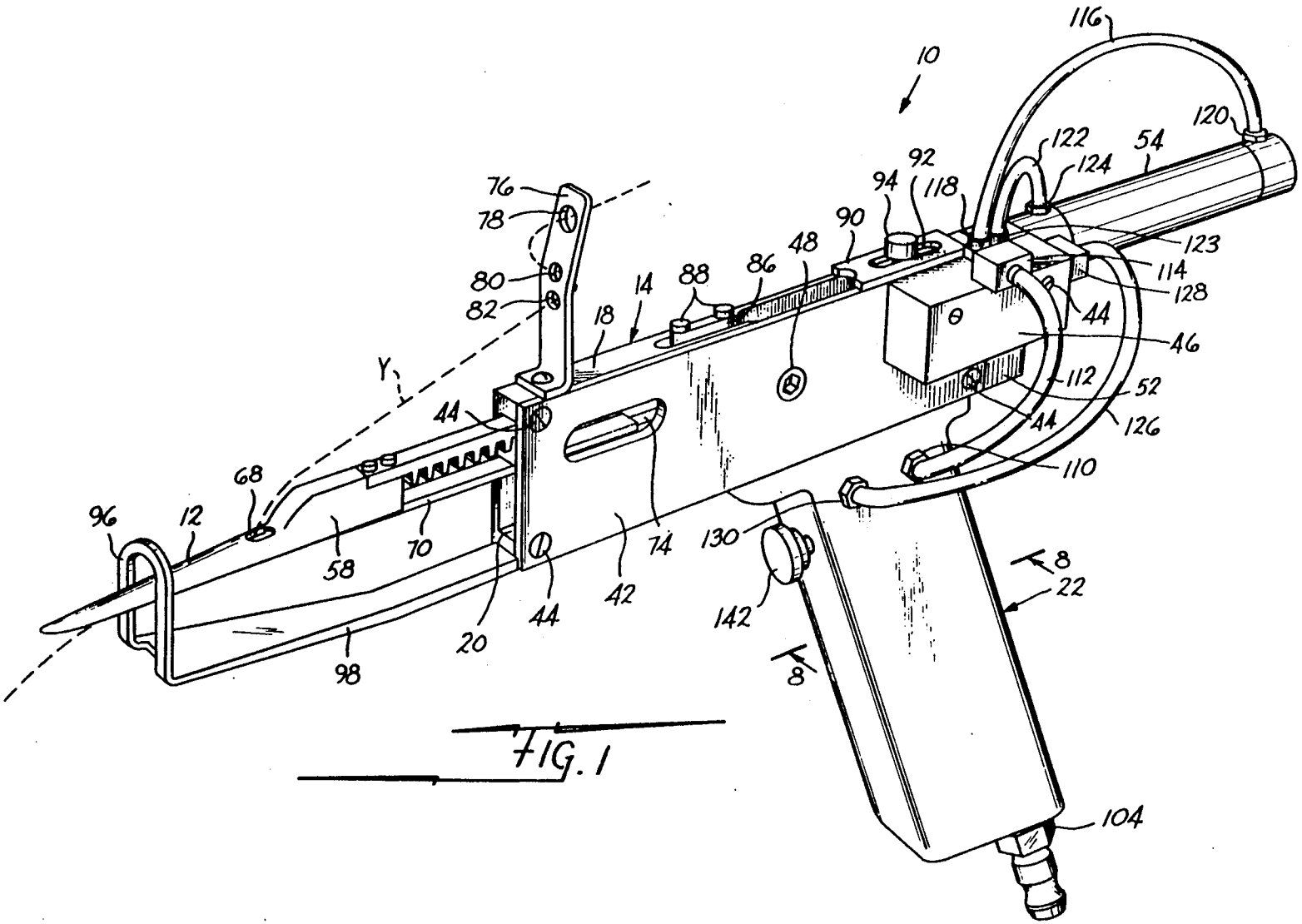
FIG. 1 is a perspective view of a hand-held tufting mending gun constructed in accordance with the principles of the present invention.
Figure 2:
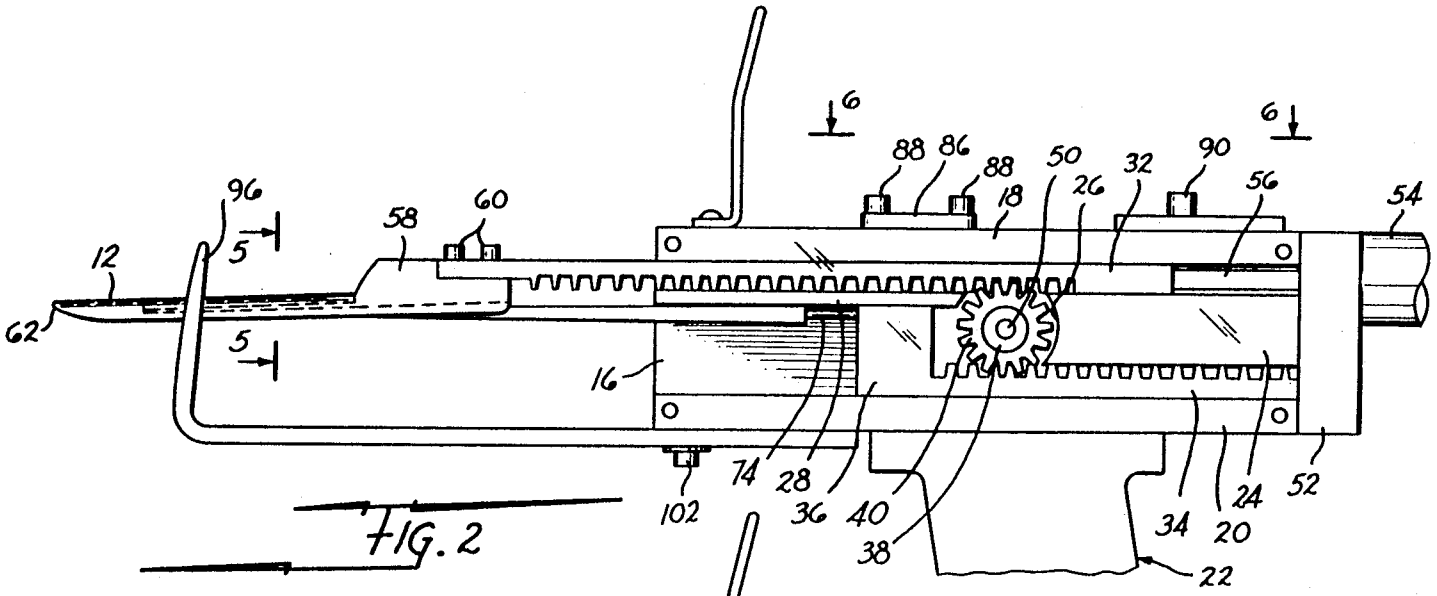
FIG. 2 is a fragmentary side elevational view of the gun illustrated in FIG. 1 with the housing cover plate and the valving removed depicting the needle just prior to reaching the forward position.

Referring now to the drawings, and particularly to FIGS. 1 and 2, a hand-held tufting mending gun generally indicated at 10 is illustrated with the needle 12 in the forward position. The gun includes a housing 14 comprising a mounting plate 16 having a pair of spaced apart rails 18, 20, the rail 18 being at the top of the plate and the rail 20 being at the bottom. Secured to the bottom rail 20 by means of screws or the like (not illustrated) is a handle 22 adapted to be grasped by an operator. Formed in the central portion of the mounting plate 16 extending from the rear end of the gun remote from the needle end is a central rail 24 having an arcuate surface 26 at the forward end thereof. Another rail 28, substantially narrower than the rail 24, having an upper surface lying in the same plane as the upper surface of the rail 24 is formed on the mounting plate 16 at the forward end and has an arcuate surface 30 at the rear thereof, the arcuate rear end surface 30 of the rail 28 being spaced longitudinally from the arcuate surface 26 of the rail 24. The space between the lower surface of the upper rail 18 and the upper surface of the rail 24 form a first slideway for receiving a gear rack 32, while the space between the lower surface of the rail 24 and the upper surface of the lower rail 20 form a second slideway for receiving another gear rack 34. The forward end of the gear rack 34 has an upstanding plunger mounting block 36 secured thereto, the upper surface of the plunger mounting block being adapted for sliding against the lower surface of the forward rail 28.

Secured to the mounting plate 16 intermediate the respective arcuate surfaces 26 and 30 of the rails 24 and 28, and intermediate the gear racks 32 and 34 is an annular axle 38. A pinion gear 40 is rotatably disposed about the axle 38 with the teeth thereof meshing with the teeth of the gear racks 32 and 34. A cover plate 42 is secured to the rails 18 and 20 by means of screws 44 or the like, the upper screw at the rear end also may aid in securing the housing of a valve 46 to the cover plate. An additional screw 48 is received within the central portion of the cover plate and is threadedly received within a threaded bore 50 in the axle 38.

Figure 3:
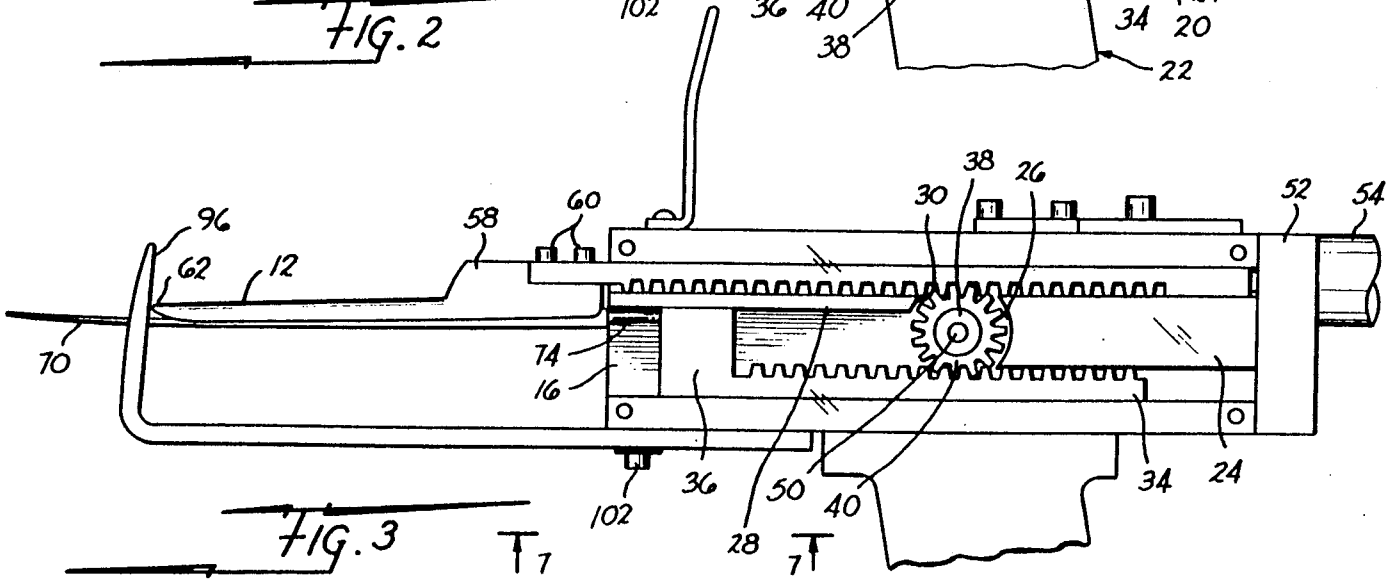
FIG. 3 is a view similar to FIG. 2 depicting the needle plunger just prior to reaching the forward position.
Figure 4:
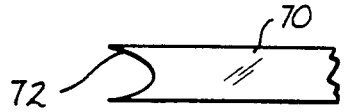
FIG. 4 is a fragmentary top plan view of the working or forward end of the plunger.

Secured at the rear of the gun to the end of the rails 18, 20 and 24 is a cylinder mounting block 52 which also abuts the rear end of the cover plate 42. Fastened to the block 52 is the housing 54 of a pneumatic cylinder having a piston (not illustrated) mounted internally thereof, the piston rod 56 extending through a bore in the mounting block 52 and being threadedly attached to the rear end of the upper gear rack 32 Thus, extension of the piston rod slidably drives the gear rack 32 to the left as illustrated in FIG. 2 and retraction thereof slidably pulls the gear rack 32 to the right as illustrated in FIG. 3. As the gear rack 32 moves to the left it drives the pinion gear 40 causing it to rotate counterclockwise thereby driving the lower gear rack 34 rearwardly to the right as illustrated in FIG. 2, and alternately when the piston rod is retracted the gear rack 32 drives the pinion gear 40 clockwise and the lower rack 34 forwardly to the left as illustrated in FIG. 3.

Figure 5:
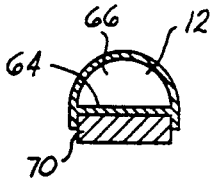
FIG. 5 is a fragmentary cross sectional view taken substantially along the line 5—5 of FIG. 2.

Secured at the front end of the upper gear rack 32 is the mounting portion 58 of the needle 12, the mounting portion having an offset at its rear end to which the forward end of the rack 32 is secured by screws 60 or the like. The needle 12 has an arcuate cross sectional configuration with a point 62 at the leading edge, and has a narrow plate 64, as illustrated in FIG. 5, extending transversely at its sides spaced slightly from the lower edges of the arcuate form, the leading edge of the plate 64 being disposed rearwardly of the point 62 and extending rearwardly to form a lower surface of the mounting portion 58, the mounting portion having side walls extending downwardly beyond the plate 64. A hollow 66 is thus formed in the needle above the plate 64 and communicates with an aperture 68 in the upper portion of the needle, just forward of the mounting portion, so that yarn Y can be threaded through the hollow and out the pointed end. The channel formed by the plate 64 with the lower portion of the side edges of the needle 12 and the mounting portion 58 receives a longitudinally needle plunger 70, the front portion of the needle plunger having a rectangular configuration with a U-shaped slot at the leading edge. The rear of the plunger is formed with a cylindrical shank 74 which is received within a bore in the plunger mounting block 36 and secured thereto by a set screw or the like (not illustrated).

After the needle has penetrated the backing material of the carpet being repaired, and before the needle is retracted from the backing, the plunger as it moves forward grasps the yarn loop formed between the strand Y extending through the needle and the leg of the yarn from the loose leading end of the yarn or the leg extending from a previous stitch, and pulls the loop forwardly to the end of its travel. As is well known in the art, the two legs of the yarn are then frictionally held in the backing as the plunger begins its return stroke. The yarn is fed through the eyelets of a yarn guide 76 extending through a first eyelet 78 from the supply over the forward face of the yarn guide 76 into a second eyelet 80 and back along the rear face of the yarn guide 76 through the third eyelet 82 prior to entry into the opening 68 in the needle, the three eyelet arrangement being such as to provide tension for preventing the yarn from unthreading from the needle.

Figure 6:
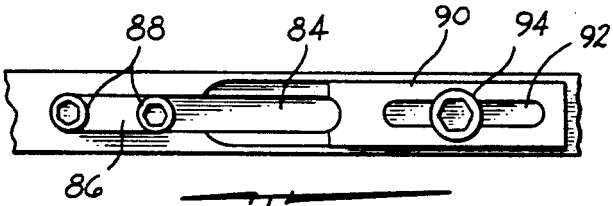
FIG. 6 is a fragmentary top plan view of a portion of the mending gun taken substantially along the line 6—6 of FIG. 2 with the needle in the forwardmost position and illustrating the return stroke adjusting means.

Formed in the top of the upper rail 18 extending longitudinally forwardly and rearwardly of the disposition of the pinion gear 40 is a recess 84 for receiving a small block 86 which is secured by shoulder screws 88 to the top of the upper gear rack 32. Preferably, as illustrated in FIG. 6, the front and rear surfaces of the block 86 are arcuate as is the front and rear ends of the recess 84. When the needle reaches the end of its forward stroke the block 86 abuts the leading edge of the recess 84 so that the forward stroke of the needle always terminates at a constant point. In order to control the return stroke of the needle and thus the forward stroke of the plunger 70, and thereby the pile height of the tufted stitch being formed, a pile height adjustment block 90 is adjustably secured to the top of the rail 18. The adjustment block 90 includes a longitudinally extending slot 92 through which the threaded end of a shoulder screw 94 extends and is threaded into the rail 18. The adjustment block 90 can thus be secured in selected positions merely by loosening the screw 94, moving the block to a selected disposition and resecuring the screw 94. In the adjusted position the head of the rear screw 88 of the block 86 abuts the leading edge of the plate 90 to terminate the return stroke of the rack 32, and thus the forward stroke of the plunger 70 so as to adjust the pile height. Clearly to shorten the pile height the adjusting plate 92 is moved forwardly to shorten the overall stroke of the needle and plunger, and moved rearwardly to increase the pile height.

Figure 7:
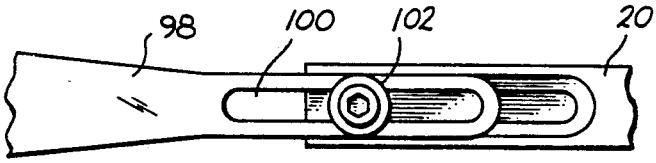
FIG. 7 is a fragmentary bottom plan view of the forward end of the gun taken substantially along the line 7—7 of FIG. 2 illustrating the presser foot adjusting means.

Additionally, a presser foot fence 96 having an upstanding yoke configuration, through which the needle 12 and the plunger may enter on their respective forward strokes and may exit on their respective rear strokes, extends upwardly from a presser foot shank 98 adjustably secured to the bottom rail 20. As illustrated in FIG. 7, the rear of the presser foot shank 98 includes a slot 100 for adjustably receiving the shank of a shoulder screw 102 so that the presser foot fence 96 may be adjustably moved forwardly or rearwardly. When the pile height is to be adjusted by means of the plate 90, the presser foot fence must also be adjusted so that the needle on its return stroke clears the fabric and the rear of the presser foot fence as illustrated in FIG. 3. The presser foot fence 96 is always adjusted in the same direction as the pile height adjusting plate 90, forwardly to shorten the pile height and rearwardly to increase the pile height.

Figure 8:
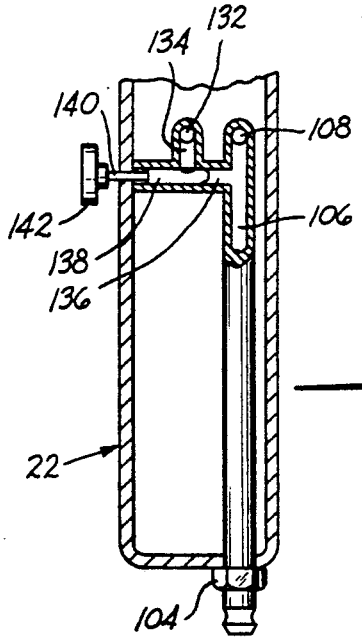
FIG. 8 is a fragmentary cross sectional view taken through the handle of the gun substantially along line 8—8 illustrating the trigger actuated air passage control means.

The handle 22 is substantially hollow and includes a fitting 104 at the bottom for connection of the mending gun to a high pressure source of air commonly found in carpet mills. As illustrated in FIG. 8, the interior of the handle includes a conduit 106 connected to the fitting so as to be in flow communication therewith so that when the fitting is connected to an air supply source, air flows through the conduit 106 and out a portal 108 at the outlet end of the conduit 106, the portal communicating with a fitting 110 mounted on the exterior of the handle. Connected to the fitting 110 is one end of a flexible conduit 112, the other end of which is connected by a fitting 114 to the supply port of the valve 46. The valve 46 is a two position balanced spool fourway valve having a supply port, two outlet ports, two exhaust ports and a pilot port, the pilot acting as a control. A valve of this type is manufactured by Clippard Company of Cincinnati, Ohio under the Clippard Eagle E-4 series, and specifically in the preferred embodiment a model E-4-1PS has been utilized successfully. When air is supplied to the supply port through the conduit 106 when the mending gun is connected to an air supply line, a first outlet port of the valve supplies air, and when the pilot port receives air, the second outlet port supplies air, in each case air is exhausted through a separate exhaust port. Accordingly, in order to selectively control the actuation of the pneumatic piston/cylinder 54, and thus the extension of the piston rod 56, a flexible conduit 116 is connected by fittings 118, 120 respectively to the first outlet port of the valve and the head end of the piston/cylinder 54, and a second flexible conduit 122 has its respective ends connected to a fitting 123 at the second outlet port of the valve 46 and a fitting 124 communicating with the piston rod end, or tail end, of the pneumatic piston/cylinder 54. Additionally, a flexible conduit 126 is connected at one end to a fitting 128 at the pilot port of the valve and has its other end connected to a fitting 130 mounted on the handle 22 adjacent to the fitting 110.

The fitting 130 communicates internally into the handle through a port 132 which communicates with a small conduit 134 within the handle 22. Another conduit 136 within the handle selectively communicates the conduit 106 with the conduit 134, a small normally closed, two-way poppet cartridge valve 138, such as Clippard model MAV-2C, extending into the conduit 136 to normally close communication between conduits 136 and 134. The valve 136 has an actuation stem 140 extending outwardly from the handle and to which a trigger button 142 is fastened. Depression of the trigger and thus the stem 140 opens a passageway in the valve 138 to permit air to flow from the conduit 136 into the conduit 134 and thus to the pilot port of the valve 46 which acts to port air to the tail end of the pneumatic piston/cylinder 54. When supply air is attached to the fitting 104 air fed from the port 108 to the supply port of the valve 46 communicates air to the head end of the cylinder to drive the upper rack 32 and the needle 12 forwardly. When the trigger 142 is mashed or squeezed, the valve 138 permits air to flow through the port 132 to the pilot port of the valve 46. This acts to exhaust air from the head end and supplies the air to the tail end to drive the upper rack 32 and the needle 12 rearwardly. Of course, as the needle goes forwardly the yarn grasping plunger 70 moves rearwardly and as the needle moves rearwardly, the yarn grasping plunger 70 moves forwardly to grasp a loop of yarn. When the trigger is released, the valve 138 closes the communication between the conduit 136 and the conduit 134, and the air supplied from the portal 108 to the supply port of the valve 46 again drives the needle 12 forwardly as air is exhausted from the tail end of the cylinder through the second exhaust port.

In operation, an operator prior to mashing the trigger 142 may insert the point of the needle into the backing material of the carpet, thereafter squeeze the trigger 142 to drive the plunger forwardly and the needle rearwardly, so that the slotted portion 72 of the plunger grasps the loop of yarn and holds it, and upon release of the trigger, the plunger moves rearwardly and the needle again moves forwardly. The loop of yarn being held by friction in the backing material remains in the carpet. If a series of stitches is desired to be inserted into the backing material, the operator merely initially inserts the needle, squeezes the button, releases the button and repeats the sequencing for each stitch desired to be inserted into the backing material of the carpet. Since a single stitch is formed each time the trigger is squeezed, the operator can selectively insert a stitch at precise selected positions in the backing so as to form stitches corresponding to the pattern of the carpet produced to substitute stitches for the tufting machine needle or needles that were unthreaded.

The mending gun of the present invention can also be utilized as a slow acting mending gun by valving which permits the piston within the piston/cylinder 54 to move forwardly and rearwardly while the trigger is held squeezed in to form a series of stitches in the backing material, i.e., each time the trigger is held depressed the cylinder will continue to cycle at a very slow rate. In this case the only modification to the gun as heretofore described is the removal of the valve 46 and replacement thereof by other valving, and plugging of the fitting 104. For example, utilization of sequence valving such as a Clippard Model CM-06 sequence subplate for three valves, used in conjunction with two Clippard model R301 three-way valves and one Clippard model R402 four-way valve provides this sequencing. The 3-way valves are single piloted while the 4-way valve is double piloted. The sequence subplate, which has speed selection for the sequencing, mounts the three valves, and has passageways formed therein for directing the air between the valves from the supply, the ports 108 and 138 and the outlets to the cylinder 54. Because the size of such a unit makes the gun heavy, it is not mounted on the mending gun, but mounted above the tufting machine (not illustrated). Air that would be supplied to the fitting 104 is fed to a supply port of the subplate which has two control outlet ports connected in communication with the parts 108, 132 of the mending gun, and two outlet ports for extending and retracting the piston in sequence. All the components are off-the-shelf and utilized in conventional manner. Depression of the trigger 142 begins the cycle and release of the trigger terminates the cycle. Thus the mending gun 10 may be utilized as a very slow acting mending gun to form a series of stitches with the position of the stitches selected readily by the operator.

Figure 9:
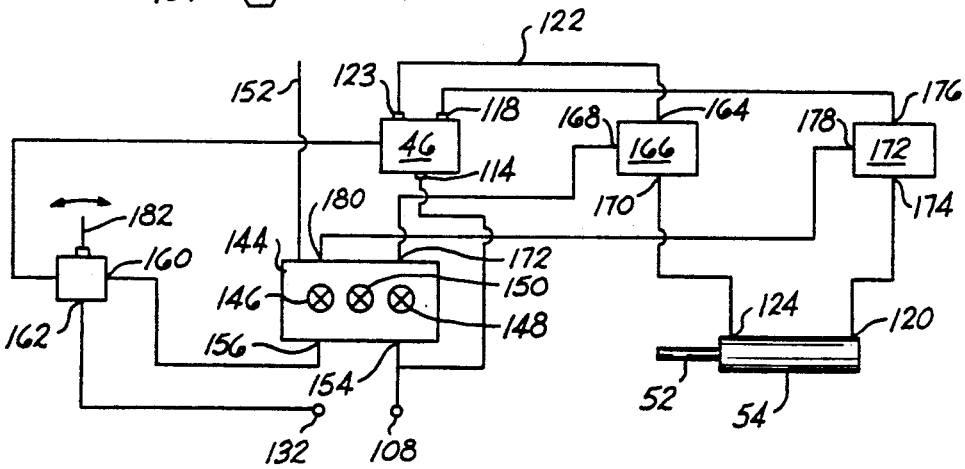
FIG. 9 is a schematic view of the valving for selecting either a single stitch or a multiple stitch mode.

Moreover, by utilizing a switching arrangement, the valve 46 may be utilized in conjunction with the slow acting sequencing valving to select the mode of operation as either a one-shot firing of the mending gun, or a slow sequence firing of the mending gun upon depression of the trigger 142. For example, as illustrated schematically in FIG. 9, a sequence subplate 144 such as the aforesaid Clippard model CM-06 may be utilized in conjunction with two three-way valves 146, 148 and a four-way valve 150, each valve being of the aforesaid type, the sequencing subplate being supplied with air from a supply conduit 152 which would otherwise be supplied to the plugged fitting 104. The sequence subplate has one outlet 154 connected to the port 108 of the mending gun, and another port 156 connected to a toggle actuated four-way poppet valve 160 having three positions, one of which is vented and the other two of which are jog or manual control. One outlet 162 is connected in communication with the port 132 of the mending gun, while the other outlet is connected to the pilot port fitting 128 of the valve 46. The conduit 122 is connected at one end to the fitting 123 of the valve 46 and at its other end is connected to a first inlet port 164 of a shuttle valve 166, which is a double check valve having two other ports 168, 170 in addition to the port 164, the port 170 being an outlet port connected to the fitting 124 at the tail end of the cylinder 54. Another valve 172 identical to the valve 166 has its outlet port 174 connected to the fitting 120 of the cylinder 54 and has its inlet ports 176, 178 respectively connected to the fitting 118 at the other outlet port of the valve 46, and an outlet port 180 of the sequence subplate 144. The valves 166 and 172 may be Clippard model MSV-1 shuttle valves and the air may be ported from one of the inlets to the outlet, and exhaust through the port where pressure was last applied. When an operator throws the toggle 182 of the four-way poppet valve 160 in one direction and depresses the trigger 142 the valving will actuate the cylinder for one cycle as described above, or if the toggle is thrown in the other direction the valving will be actuated to bypass the valve 46 and activate the sequencing of the valves 146, 148, 150 to cycle the cylinder 54 in a slow cycling mode. The capabilities of a mending gun operating either on a one-shot basis and/or on a slow acting continuous basis has not previously been available in the carpet industry.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A hand-held tufting mending gun for use with a source of pressurized air for forming stitches of yarn in a backing material, said gun comprising a frame, a needle drive member mounted for reciprocation in said frame, a hollow yarn receiving needle having a point at one end through which yarn may project, means for mounting said needle to said drive member with said point extending in a first direction remote from said drive member, a yarn manipulating plunger having a yarn manipulating end, a plunger drive member mounted for reciprocation in said frame, means for mounting said plunger to said plunger drive member adjacent said needle with said yarn manipulating end of said plunger extending in said first direction for grasping a loop of yarn from said needle, power drive means for drivingly reciprocating said needle drive member, said drive means comprising a pneumatic cylinder fixed to said frame and including a piston rod operatively connected to said needle drive member for driving said needle drive member in said first direction when said piston rod is extended and for driving said needle drive member in the reverse direction when said piston rod is retracted relative to said cylinder, coupling means for interconnecting said needle drive member and said plunger drive member for driving said plunger drive member in opposite directions relative to said needle drive member when said needle drive member is driven and in timed relationship therewith such that while said needle moves in said first direction said plunger moves in said reverse direction, valve means for porting pressurized air to respective ends of said cylinder to extend and retract said piston rod from said cylinder, and operator influenced means for opening and closing passage of air to said valve means selectively.

2. A hand-held tufting mending gun as recited in claim 1, wherein said frame includes means defining two slideways, said needle drive member being slidably disposed in one slideway, and said plunger drive means being slidably disposed in the other slideway, and said coupling means being disposed intermediate said slideways.

3. A hand-held tufting mending gun as recited in claim 1, wherein said operator influenced means includes a depressable trigger, and said valve means comprises means for porting pressurized air to one end of said cylinder when said trigger is depressed and for porting pressurized air to the other end of said cylinder when said trigger is released.

4. A hand-held tufting mending gun as recited in claim 3, wherein said frame includes means defining two slideways, said needle drive member being slidably disposed in one slideway, and said plunger drive member being slidably disposed in the other slideway.

5. A hand-held tufting mending gun as recited in claim 1, wherein said operator influenced means includes a depressable trigger, and said valve means comprises sequencing means for porting pressurized air first to one end and then to the other end of said cylinder as long as said trigger is depressed.

6. A hand-held tufting mending gun as recited in claim 5, wherein said frame includes means defining two slideways, said needle drive member being slidably disposed in one slideway, and said plunger drive member being slidably disposed in the other slideway.

7. A hand-held tufting mending gun as recited in claim 1, wherein said operator influenced means includes a depressable trigger, and said valve means includes first valve means for porting pressurized air to one end of said cylinder when said trigger is depressed and for porting pressurized air to the other end of said cylinder when said trigger is released, and second valve means including sequencing means for porting pressurized air first to one end and then the other end of said cylinder as long as said trigger is depressed, and third valve means for selecting either said first valve means or said second valve means.

8. A hand-held tufting mending gun as recited in claim 7, wherein said frame includes means defining two slideways, said needle drive member being slidably disposed in one slideway, and said plunger drive member being slidably disposed in the other slideway.

9. A hand-held tufting mending gun for use with a source of pressurized air for forming stitches of yarn in a backing material, said gun comprising a frame including means defining two slideways, a needle drive member slidably mounted for reciprocation in one slideway, a hollow yarn receiving needle having a point at one end through which yarn may project, means for mounting said needle to said drive member with said point extending in a first direction remote from said drive member, a yarn manipulating plunger having a yarn manipulating end, a plunger drive member slidably mounted for reciprocation in the other slideway, means for mounting said plunger to said plunger drive member adjacent said needle with said yarn manipulating end of said plunger extending in said first direction for grasping a loop of yarn from said needle, power drive means for drivingly reciprocating said needle drive member, said drive means comprising a pneumatic cylinder fixed to said frame and including a piston rod operatively connected to said needle drive member for driving said needle drive member in said first direction when said piston rod is extended and for driving said needle drive member in the reverse direction when said piston rod is retracted relative to said cylinder, said needle drive member and said plunger drive member each comprising a rack having a plurality of teeth, a pinion gear rotatably journalled in said frame intermediate said slideways and having teeth operatively meshing with the teeth of said gear racks for driving said plunger drive member in opposite directions relative to said needle drive member and in timed relationship therewith such that as said needle moves in said first direction said plunger moves in said reverse direction, valve means for porting pressurized air to respective ends of said cylinder to extend and retract said piston rod from said cylinder, and operator influenced means for opening and closing passage of air to said valve means selectively.

10. A hand-held tufting mending gun as recited in claim 9, wherein said operator influenced means includes a depressable trigger, and said valve means comprises means for porting pressurized air to one end of said cylinder when said trigger is depressed and for porting pressurized air to the other end of said cylinder when said trigger is released.

11. A hand-held tufting mending gun as recited in claim 9, wherein said operator influenced means includes a depressable trigger, and said valve means comprises sequencing means for porting pressurized air first to one end and then to the other end of said cylinder as long as said trigger is depressed.

12. A hand-held tufting mending gun as recited in claim 9, wherein said operator influenced means includes a depressable trigger, and said valve means includes first valve means for porting pressurized air to one end of said cylinder when said trigger is depressed and for porting pressurized air to the other end of said cylinder when said trigger is released, and second valve means including sequencing means for porting pressurized air first to one end and then the other end of said cylinder as long as said trigger is depressed, and third valve means for selecting either said first valve means or said second valve means.

* * * * *